US012194361B2

(12) United States Patent
Banjo et al.

(10) Patent No.: US 12,194,361 B2
(45) Date of Patent: Jan. 14, 2025

(54) PORTABLE FIELDING SYSTEM

(71) Applicant: Defensive Reps, Carson, CA (US)

(72) Inventors: Diana Banjo, Carson, CA (US); Christina Chavez, Long Beach, CA (US)

( * ) Notice: Subject to any disclaimer, the term of this patent is extended or adjusted under 35 U.S.C. 154(b) by 417 days.

(21) Appl. No.: 17/727,777

(22) Filed: Apr. 24, 2022

(65) Prior Publication Data

US 2023/0338810 A1 Oct. 26, 2023

Related U.S. Application Data

(60) Provisional application No. 63/179,542, filed on Apr. 26, 2021.

(51) Int. Cl.

| | |
|---|---|
| ***A63B 69/40*** | (2006.01) |
| ***A63B 24/00*** | (2006.01) |
| ***A63B 47/02*** | (2006.01) |
| ***A63B 69/00*** | (2006.01) |

(52) U.S. Cl.

CPC ..... *A63B 69/407* (2013.01); *A63B 24/0087* (2013.01); *A63B 47/02* (2013.01); *A63B 69/0002* (2013.01); *A63B 2069/0008* (2013.01); *A63B 2069/0011* (2013.01); *A63B 2225/09* (2013.01)

(58) Field of Classification Search

CPC ... A63B 69/407; A63B 69/0002; A63B 69/40; A63B 2069/0008; A63B 2069/0011; F41B 7/08; F41B 7/00; F41B 3/005; F41J 9/18

See application file for complete search history.

(56) References Cited

U.S. PATENT DOCUMENTS

| | | | | |
|---|---|---|---|---|
| 4,165,729 | A * | 8/1979 | Niemirow | F41B 7/00 124/31 |
| 4,282,848 | A * | 8/1981 | Kulesza | A63B 69/408 124/16 |
| 7,028,682 | B1 * | 4/2006 | Hansen | F41B 7/00 124/16 |
| 8,245,702 | B2 * | 8/2012 | Lendvay | A01K 15/025 124/16 |
| 9,352,244 | B2 * | 5/2016 | Aguila | F41B 7/00 |
| 2012/0024277 | A1 * | 2/2012 | Wang | A63B 69/408 124/26 |
| 2017/0284764 | A1 * | 10/2017 | Mellen | F41B 7/08 |

FOREIGN PATENT DOCUMENTS

| | | | | |
|---|---|---|---|---|
| FR | 3053110 | A1 * | 12/2017 | F41B 7/08 |
| GB | 665518 | A * | 1/1952 | A63B 69/40 |

* cited by examiner

*Primary Examiner* — John E Simms, Jr.

(74) *Attorney, Agent, or Firm* — Metropolis IP Group, LLC; Eric Kang

(57) ABSTRACT

A portable fielding system comprising a Chassis Assembly, a motorized Yaw Mechanism connected to said Chassis Assembly, a motorized Pitch Mechanism connected to said Yaw Mechanism, a Ball Launcher Mechanism connected to said Pitch Mechanism, a Ball Feeder Mechanism connected to said Chassis Assembly and Ball Launcher Mechanism, and a Control System Assembly connected to said Chassis Assembly, wherein said Yaw Mechanism positions the Pitch Mechanism and Ball Launcher Mechanism at some angle about their yaw axes, wherein said Pitch Mechanism positions the Ball Launcher Mechanism at some angle about its pitch axis.

10 Claims, 16 Drawing Sheets

PORTABLE FIELDING SYSTEM

CROSS-REFERENCE TO RELATED APPLICATIONS

The present application claims priority to provisional patent application No. 63/179,542 filed on Apr. 26, 2021, disclosures of which are incorporated herein at least by reference.

FIELD OF THE DISCLOSURE

The field of the disclosure is sports training aids and more specifically, a portable baseball and softball fielding apparatus.

BACKGROUND OF THE DISCLOSURE

The purpose of a fielding system is to allow softball and baseball players the ability to receive practice repetitions when no other players, coaches, or adults are available to practice with them. In softball and baseball, it is important to practice game-time situations when the ball has been hit (or fielded) in different ways. Depending on how the player at bat hits the ball, the trajectory as it relates to velocity, yaw and pitch angle, and distance can all vary greatly. There are solutions on the market that accomplish this problem. However, these systems on the market are very expensive, difficult to move around (lacking portability and compactness), require a power outlet to power the system, and most notably do not have motorized mechanisms to vary ball trajectories with respect to its yaw and pitch axes.

SUMMARY OF THE DISCLOSURE

The presently disclosed invention is drawn to a novel, motorized fielding system capable of launching balls at a wide range of trajectories defined by its distance and orientation with respect to its yaw and pitch axes. It is also designed to be more affordable, more portable, more compact, and, for battery-powered embodiments, be substantially more convenient than anything previously available.

BRIEF DESCRIPTION OF THE DRAWINGS

The drawings are provided to facilitate understanding of the detailed description. It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE DISCLOSURE

Figure 1A:
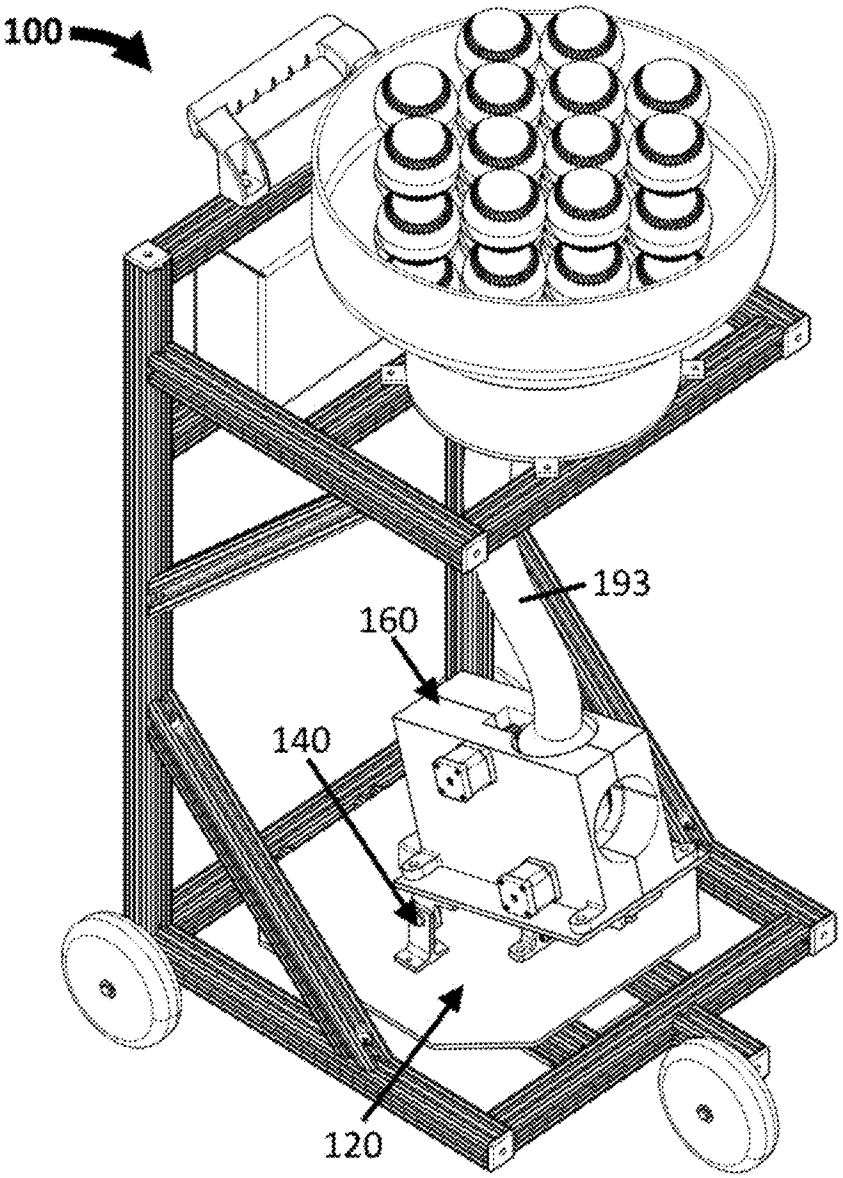
FIG. 1A shows an angled front-top view of the Portable Fielding System
Figure 1B:
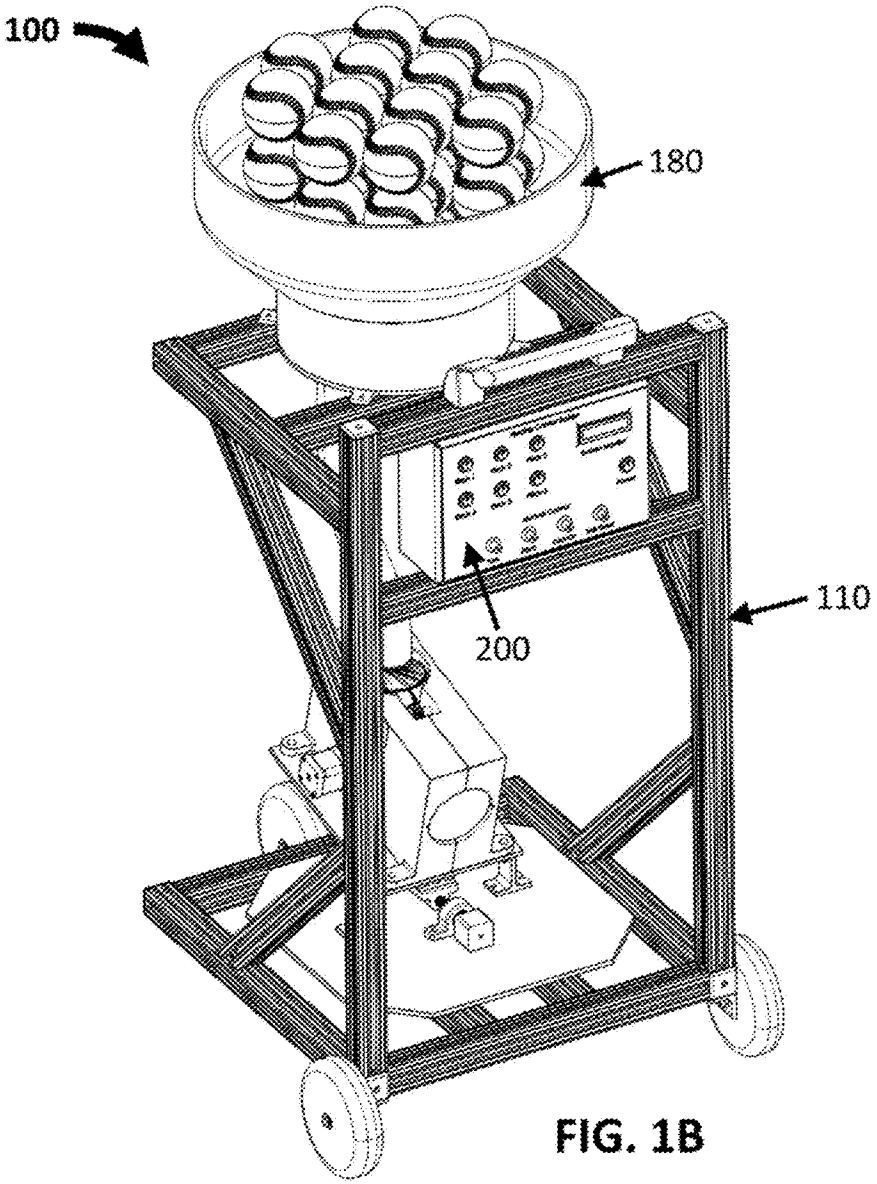
FIG. 1B shows an angled rear-top view of the Portable Fielding System
Figure 12:
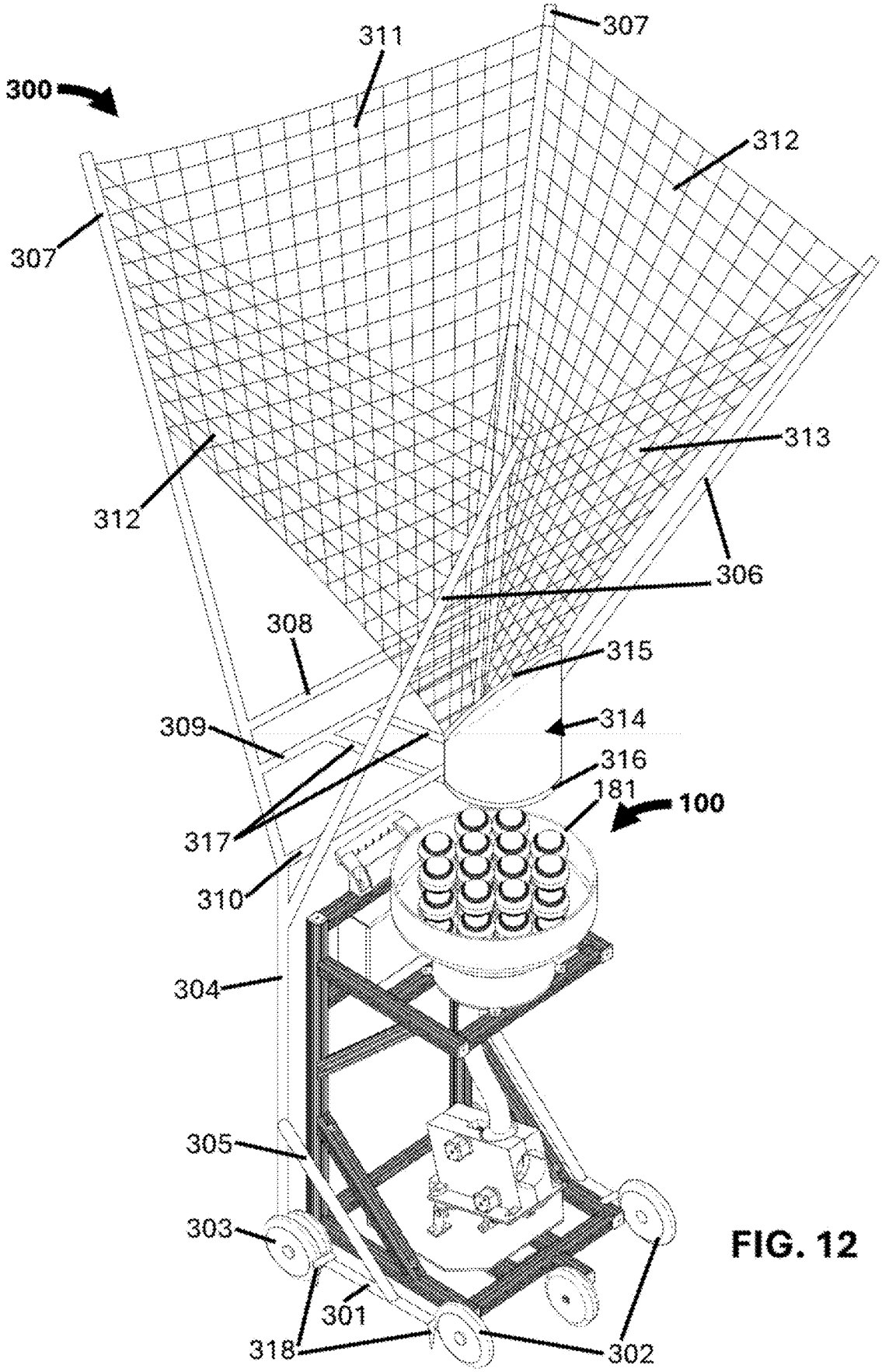
FIG. 12 shows an angled top view of the optional Ball Return Assembly of the Portable Fielding System

I) Portable Fielding System (100)—Ref. FIGS. 1A, 1B, and 12

The present invention can launch softballs and/or baseballs to various ranges (distances) and speeds. This is accomplished by using a 3-degree-of-freedom (3-DOF) approach, utilizing a plurality of mechanisms that can be controlled from either a local or remote user interface. FIGS. 1A and 1B show the different views of the entire Portable Fielding System or PFS (100) which comprises the following mechanisms: a Yaw Mechanism (120), a Pitch Mechanism (140), and a Ball Launcher Mechanism (160). The Ball Feeder Mechanism (180) with an elastic hose or netting conduit (193) feeds the softballs and/or baseballs to the Ball Launcher Mechanism (160). In order to control each of these mechanisms, an embodiment called the Control System Assembly (200) enables the user to select pre-programmed ball launch trajectories or pitch types or to manually control the Yaw, Pitch, and Ball Launcher Mechanisms (120, 140, 160, respectively) to execute ball firing at a certain trajectory. Alternative embodiments of the Ball Launcher Mechanism (160) and Control System Assembly (200) allow users to also control and execute ball motion with the desired ball launch speed and ball spin. Each of these components is mounted to a Chassis Assembly (110) in an embodiment as arranged and shown in FIGS. 1A and 1B. An optional Ball Return Assembly (300), as shown in FIG. 12, facilitates the return of fielded balls back to the Ball Feeder Mechanism (180).

II) Chassis Assembly (110)—Ref. FIGS. 2A-D

The Chassis Assembly (110) is designed to secure the various mechanisms and the Control System Assembly (120, 140, 160, 180, and 200) that enable the core operation of the PFS (100). An embodiment of the Chassis Assembly (110) frame is shown in FIGS. 2A-D, where its members are made from T-Slot extrusion, wherein adjoining members may be linked by a number of methods comprising joining plates, brackets, T-Slot screw fasteners, bolt fasteners, rivets, adhesive, or welds. The T-Slot extrusions, plates, and brackets are preferably made from aluminum by 80/20 INC.®, but alternative embodiments can be made by other suppliers as well as other metals with high strength-to-mass ratio and reasonable unit cost.

Figure 2A:
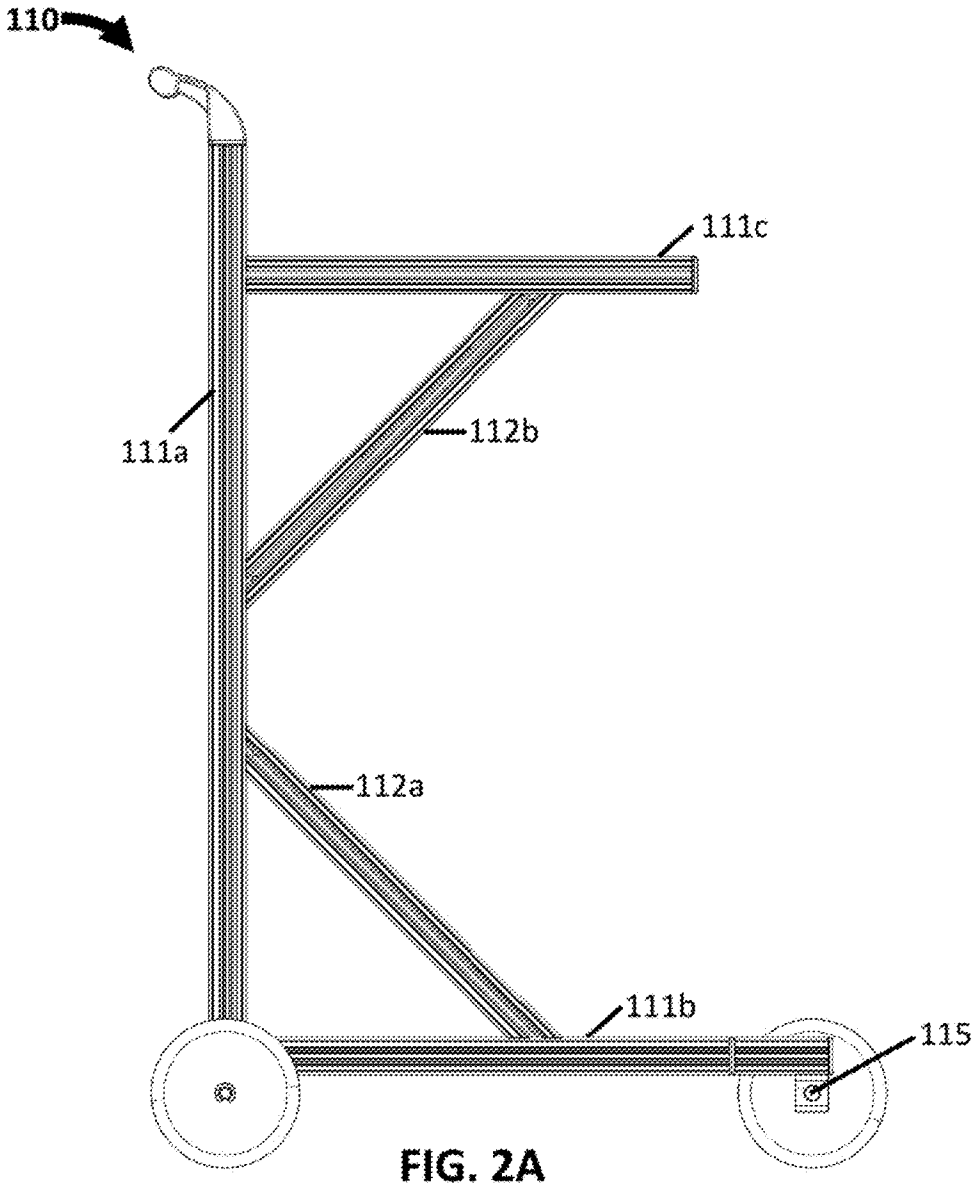
FIG. 2A shows the right side of the Chassis Assembly
Figure 2B:
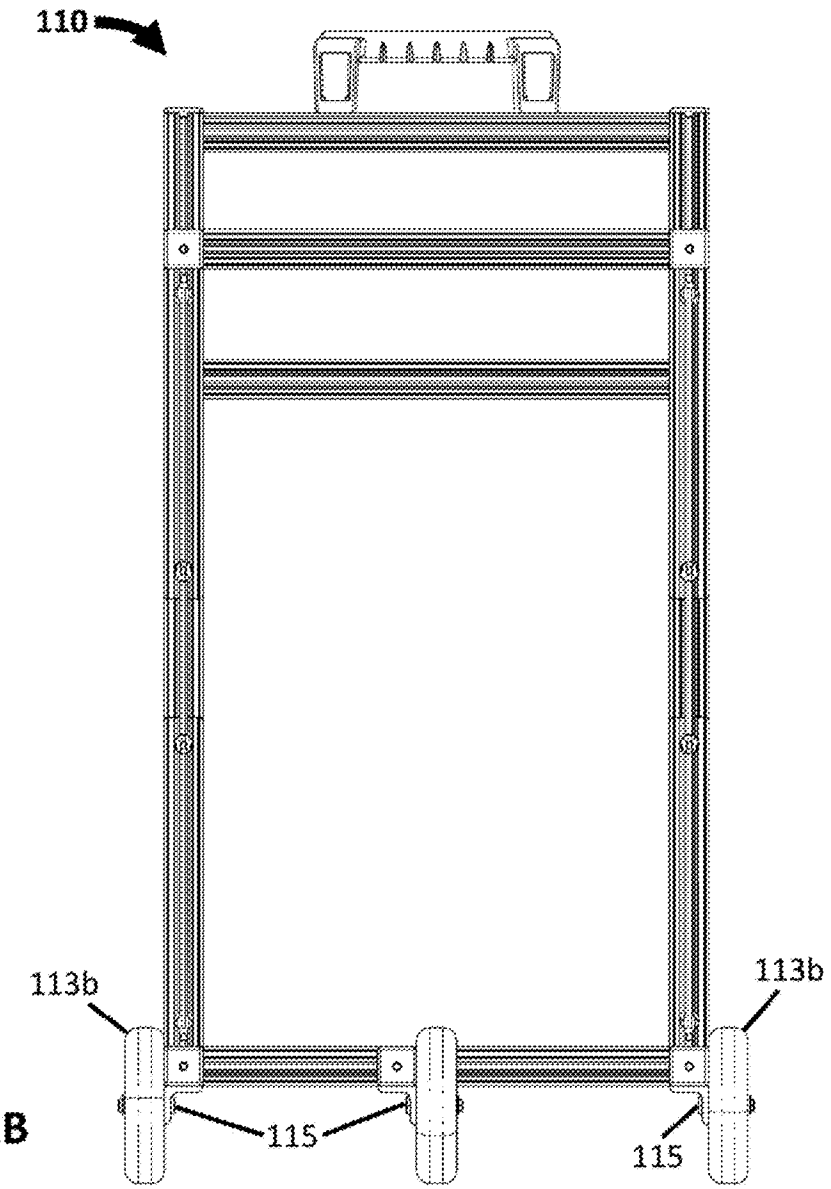
FIG. 2B shows the front of the Chassis Assembly
Figure 2C:
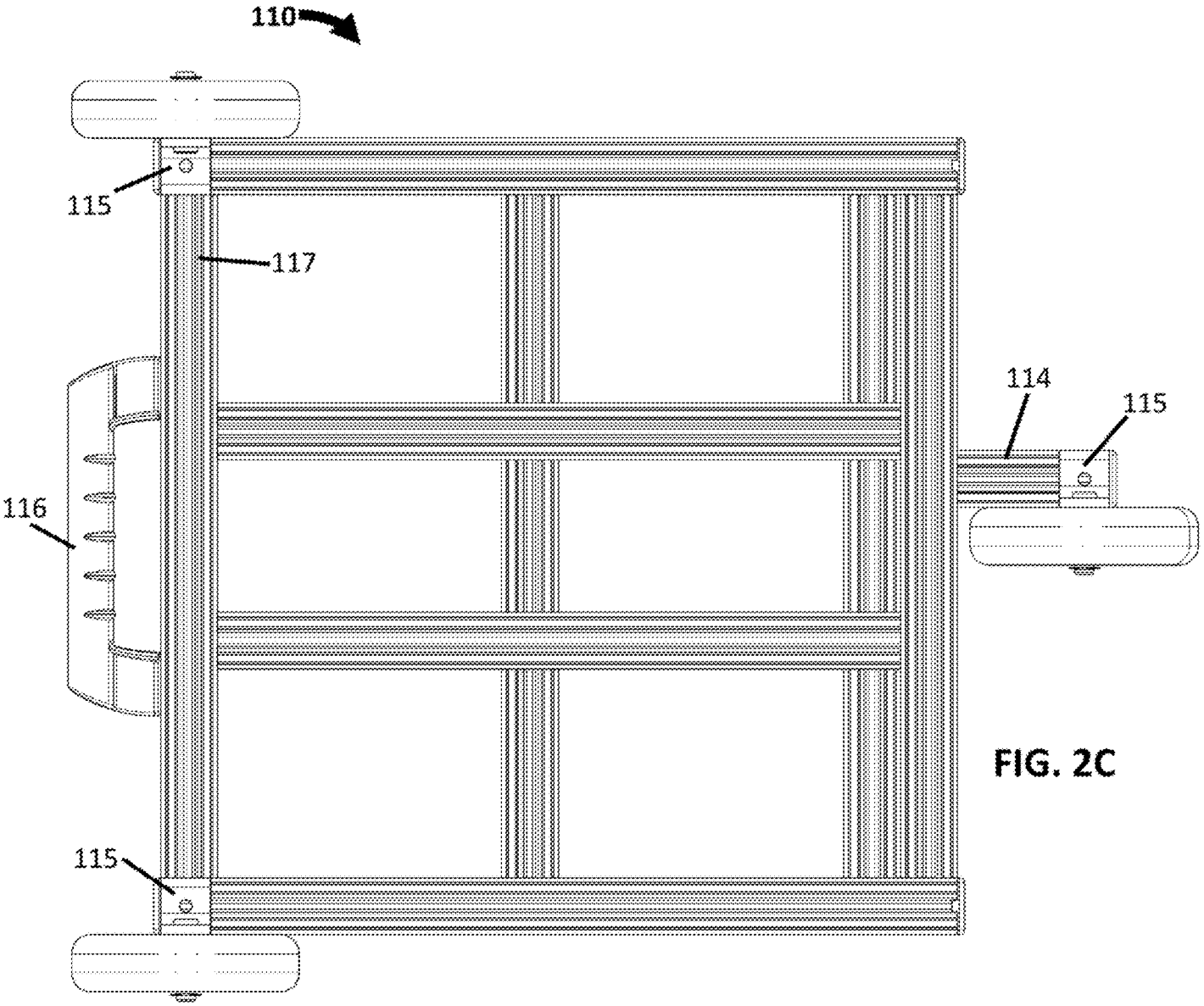
FIG. 2C shows the top of the Chassis Assembly
Figure 2D:
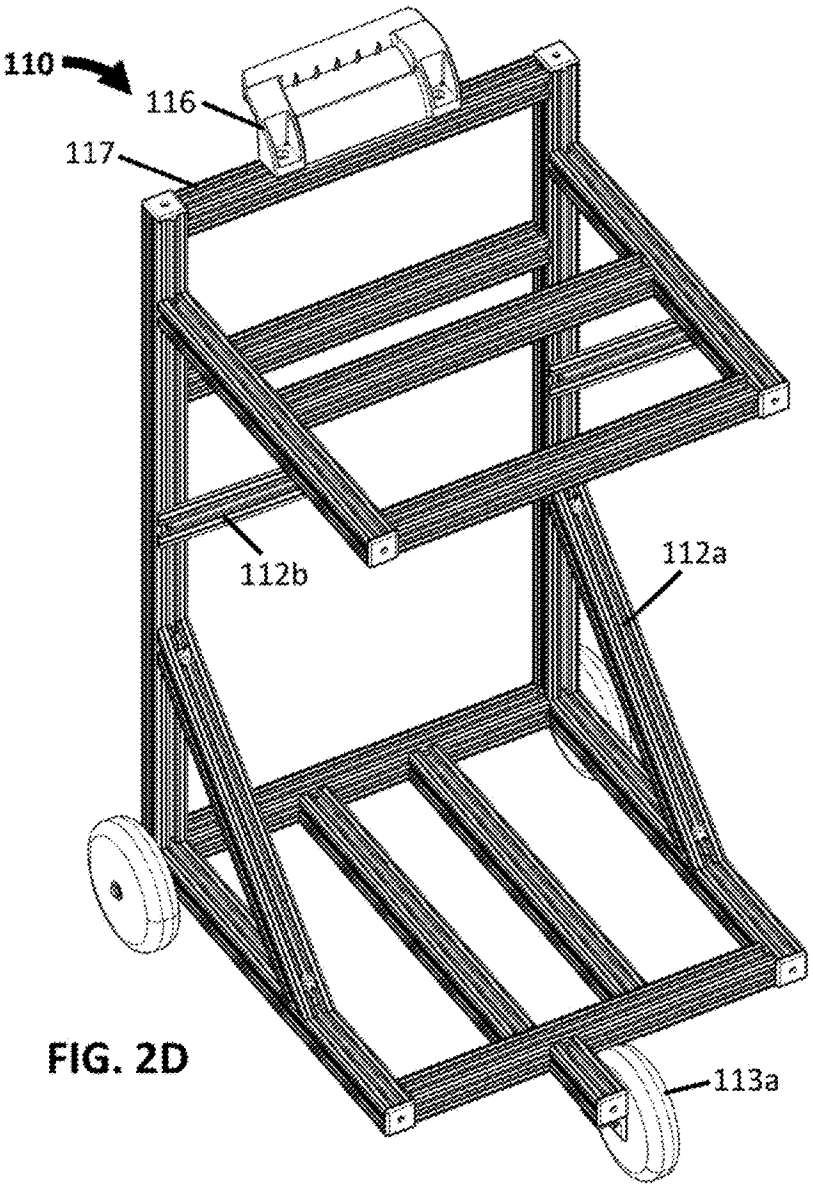
FIG. 2D shows an isometric front-top view of the Chassis Assembly

The Chassis Assembly (110) is comprised of a plurality of T-Slot extrusion members that form three planar subframes (111*a*, 111*b*, and 111*c*). The rear subframe (111*a*) is substantially perpendicular to the ground plane when the PFS (100) is upright. The two remaining subframes (111*b* and 111*c*) are substantially horizontal and parallel to the ground plane when the PFS (100) is upright. The bottom subframe (111*b*) is attached to the bottom end of the rear subframe (111*a*) while the top subframe (111*c*) is attached near the top end of the rear subframe (111*a*) as shown in FIGS. 2A, 2B, and 2D. Structural rigidity is greatly enhanced by connecting a plurality of T-Slot members arranged as diagonal braces (112*a* and 112*b*) between the bottom subframe (111*b*) to the rear subframe (111*a*) and the top subframe (111*c*) to the rear subframe (111*a*) as shown in FIGS. 2A and 2D, respectively.

An embodiment of the Chassis Assembly (110) features a 3-wheel configuration that includes a front wheel (113*a*) attached to a small member (114) extending from a front crossbar of the bottom subframe (111*b*) and a pair of back wheels (113*b*) attached near the ends of the rear crossbar of the bottom subframe (111*b*). An embodiment of the present invention has three small high-strength metal L-shaped brackets (115) attached to the Chassis Assembly (110) as shown in FIGS. 2A, 2B, and 2C to serve as the means to hold and allow free rotation of a plurality of clevis pins (one per L-bracket) that each slide through the bore of wheel bearings housed in the center bores of said wheels (113*a* and 113*b*) to serve as wheel axles. The wheels (113*a* and 113*b*) are each kept with the clevis pins by one or more retaining clips. An embodiment of the present invention allows one or more back wheels (113*b*) to be locked to prevent movement of the PFS (100).

Each of the PFS' mechanisms (120, 140, 160, and 180) can be secured to the extrusion using a plurality of T-Slot nuts and screws. A handle (116) attached to the top, rear, and upper crossbar (117) helps the user transport the PFS (100). An end cap (not shown) is attached to each of the ends of a T-Slot member to provide a finished look and minimize the chance of injury against the sharp edges of a T-Slot member.

III) Yaw Mechanism (120)—Ref. FIGS. 1A-B, 3A-D, and 4

The Yaw Mechanism or YM (120) allows the Pitch Mechanism (140) and Ball Launcher Mechanism (160) to be positioned within a range of 0 to 180 degrees about their yaw axis. The preferred embodiment of the YM (120), is shown in FIGS. 3A-D and 4, and comprises a rotary table (121) that is fixed or mounted to a centrally-located driveshaft (122), to which the Pitch Mechanism (140) can be mounted. The embodiment methods of fixing the rotary table (121) to the circular end of the driveshaft (122) can be adhesive or alternatively, by a threaded fastener (not shown) disposed through a hole in the rotary table (121) and mated to a threaded hole in the driveshaft. An alternative embodiment of rotationally coupling the rotary table (121) to the circular end of the driveshaft (122) is a key that resides in both a key seat or slot along a portion of the rotary table side of the driveshaft (122) and a keyway along a portion of the hole in the rotary table (121) used to accommodate the driveshaft.

The driveshaft (122) also passes through the bore of a ball bearing (123), which allows for smooth rotation. The ball bearing housing (124) is fixed to a thin motor mounting plate (125).

Figure 3B:
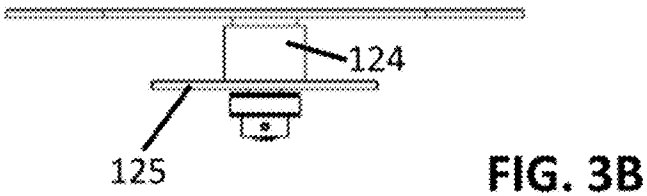
FIG. 3B shows the front of the Yaw Mechanism
Figure 3D:
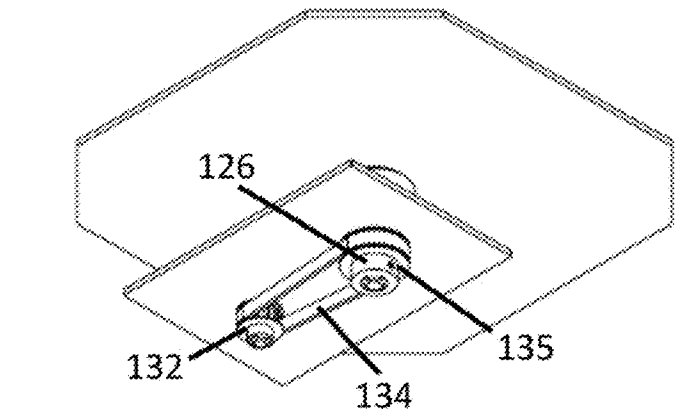
FIG. 3D shows an isometric front-bottom view of the Yaw Mechanism
Figure 3A:
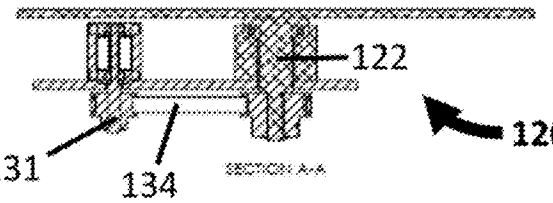
FIG. 3A shows the side A-A section view of the Yaw Mechanism
Figure 3C:
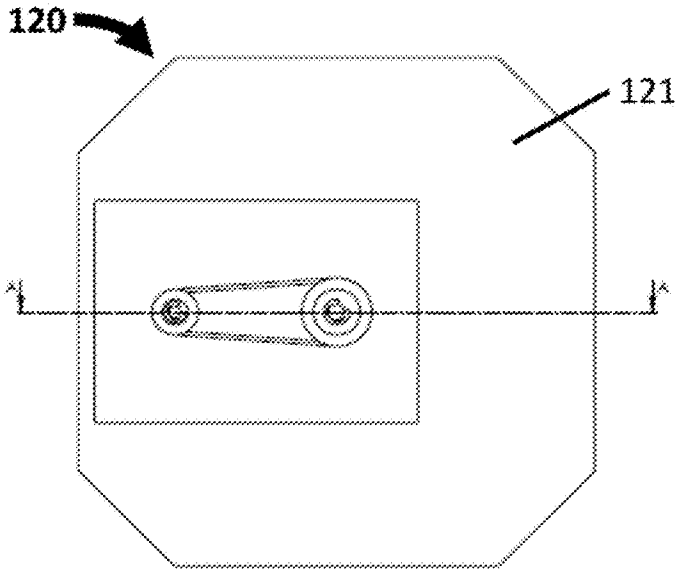
FIG. 3C shows the bottom of the Yaw Mechanism and indication of the A-A section line
Figure 4:
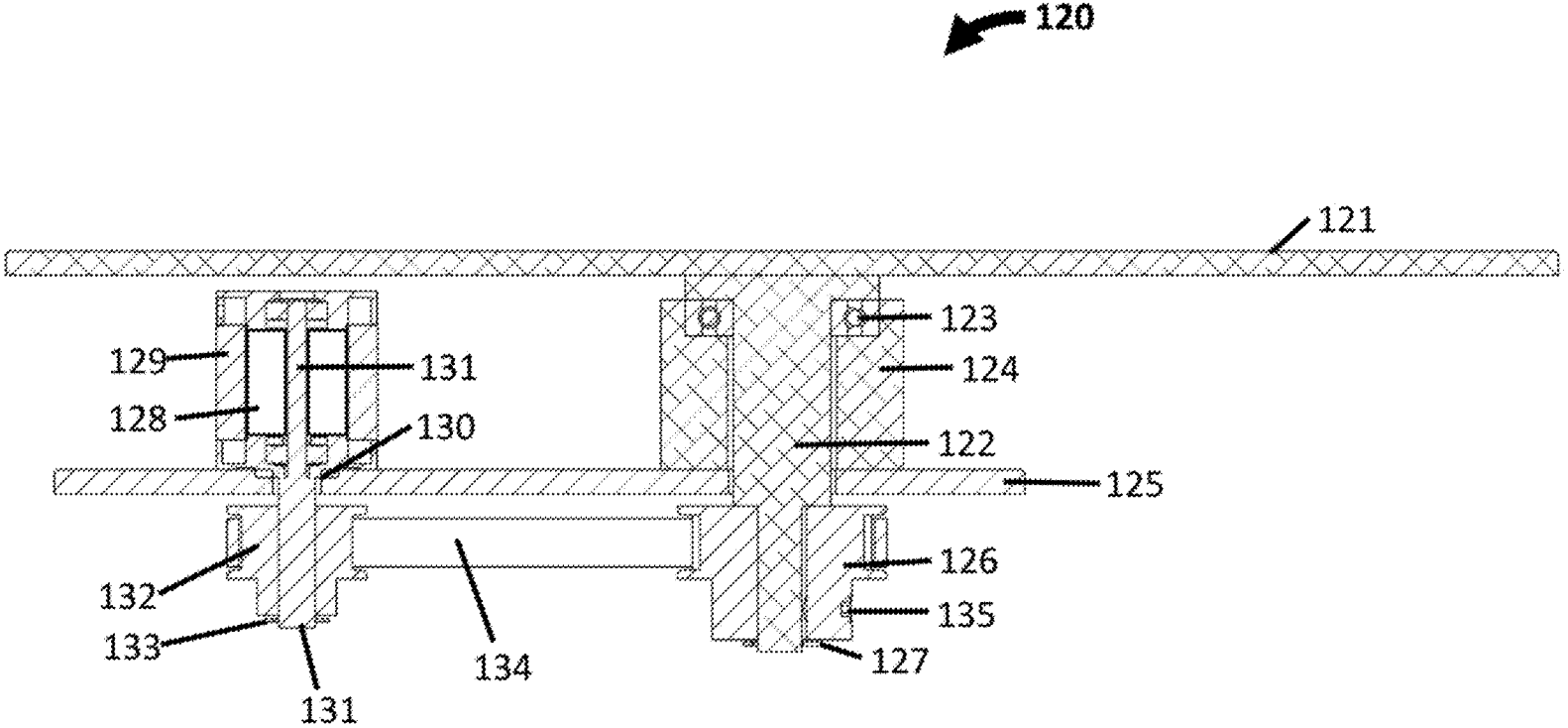
FIG. 4 shows a close-up detailed side A-A section view of the Yaw Mechanism
Figure 5B:
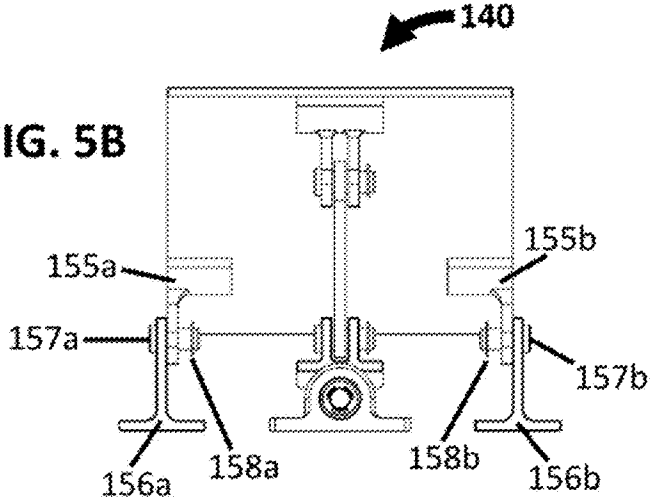
FIG. 5B shows the front view of the Pitch Mechanism
Figure 5D:
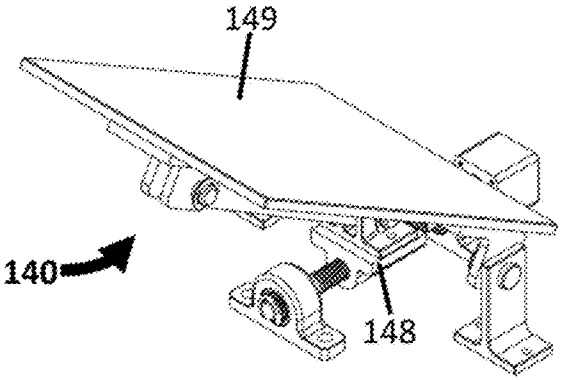
FIG. 5D shows an isometric top-front view of the Pitch Mechanism
Figure 5A:
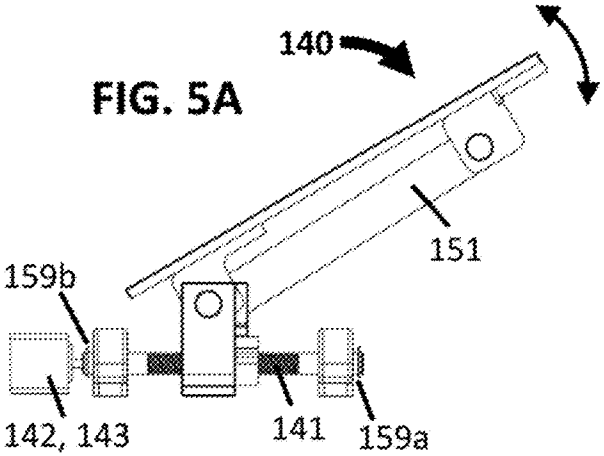
FIG. 5A shows the right-side view of the Pitch Mechanism
Figure 5C:
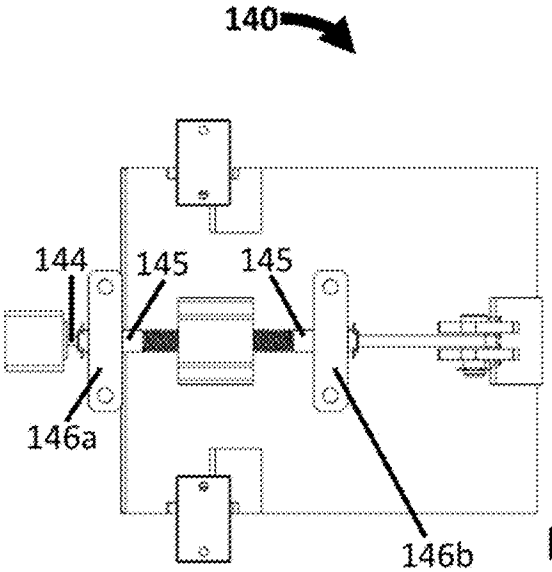
FIG. 5C shows the bottom view of the Pitch Mechanism
Figure 6:
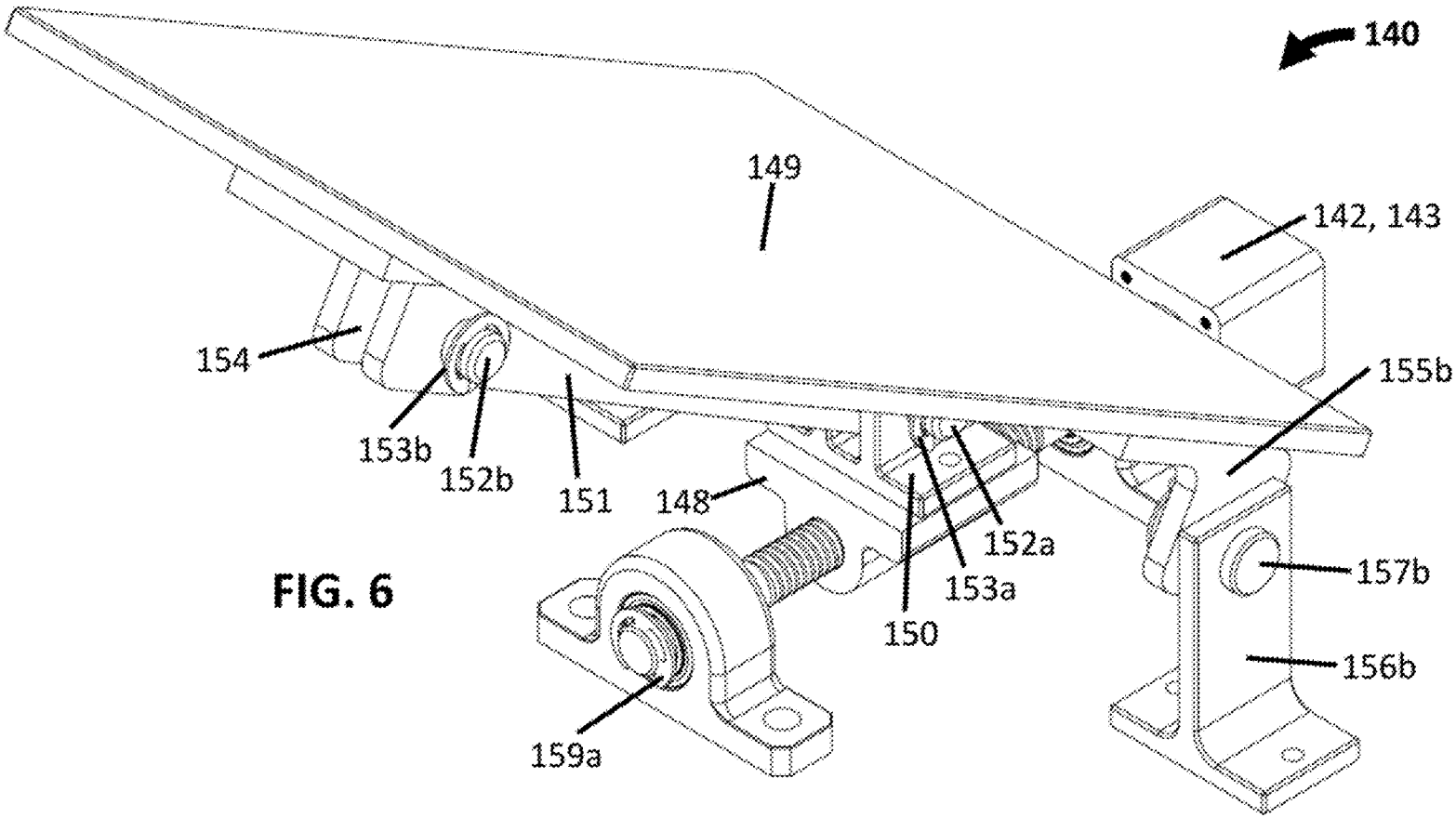
FIG. 6 shows a close-up detailed isometric top-front view of the Pitch Mechanism

The driveshaft (122) is also disposed through a hole in the thin motor mounting plate (125) and through the bore of a driveshaft pulley (126). Embodiments of this driveshaft pulley (126) include a means of preventing the driveshaft pulley (126) from sliding off the driveshaft (122) by using a retaining clip (127) as best shown in FIGS. 3C, 3D, and 4. To keep the driveshaft pulley (126) fixed in rotation with the driveshaft (122), a setscrew (135) is threaded through a hole on the side of the pulley as shown in FIGS. 3B and 3D and the tip of said setscrew (135) is in firm contact with said driveshaft (122). An alternative embodiment to rotationally couple said pulley (126) to said driveshaft (122) is a key that resides in both a keyway along a portion of the borehole of the driveshaft pulley (126) and a key seat or slot along a portion of the driveshaft's (122) surface. Another alternative embodiment to rotationally couple said pulley (126) to said driveshaft (122) is an interference fit between the mating surfaces of the driveshaft (122) and driveshaft pulley's (126) borehole.

Away from the center of the motor mounting plate (125), is a drive motor or "yaw motor" (128) inside a motor enclosure (129) that is attached to the motor mounting plate (125), as best shown in FIG. 4. An attachment embodiment of the yaw motor (128) and motor enclosure (129) to the motor mounting plate (125) is a notched depression (130) in the thin motor mounting plate (125) and a protrusion from the yaw motor (128) engaged to the notch depression (130). An alternative attachment embodiment of the yaw motor (128) and motor enclosure (129) to the motor mounting plate (125) is to have fasteners secure the motor enclosure (129) to the motor mounting plate (125).

This motor enclosure (129) is not in contact with the rotary table (121), although clearances between the motor enclosure (129) may be small to mount the Pitch Mechanism (140) and Ball Launcher Mechanism (160) as low as possible to minimize the tip-over moment applied to the PFS' (100) every time a ball is launched. An output shaft (131) of the yaw motor (128) is disposed through a motor pulley (132). An embodiment of the motor pulley (132) includes a means of preventing the motor pulley (132) from sliding off the motor's output shaft (131) by using a retaining clip (133). To keep the motor pulley (132) fixed in rotation with the motor's output shaft (131), a setscrew (not shown) is threaded through a hole on the side of the motor pulley (132) and the tip of the setscrew is in firm contact with the said output shaft (131). An alternative embodiment to rotationally couple said motor pulley (132) to said output shaft (131) is a key that resides in both a keyway along a portion of the borehole of the motor pulley (132) and a key seat or slot along a portion of the output shaft's (131) surface. Another alternative embodiment to rotationally couple said motor pulley (132) to said output shaft (131) is an interference fit between the mating surfaces of the output shaft (131) and motor pulley's (132) borehole.

A timing belt pulley (134) couples the two pullies (126 and 132) so that the torque generated from the yaw motor (128) can be transferred to the driveshaft (122) to control and spin the rotary table (121) and therefore the Pitch and Ball Launcher Mechanisms (160) about their yaw axis. The preferred material embodiment for the output shaft (131) and driveshaft (122) is a high-strength corrosion-resistant metal such as stainless steel. The preferred material embodiment for the rotary table (121) and motor mounting plate (125) is a high strength-to-mass metal that is corrosion resistant in the atmosphere like aluminum.

IV) Pitch Mechanism (140)—Ref. FIGS. 1A-B, 4, 5A-D, and 6

The Pitch Mechanism or PM (140), as shown in FIGS. 5A-D and 6, allows the Ball Launcher Mechanism (140) to position itself within a preferred range of 0 to 60 degrees about its pitch axis. The preferred embodiment method to accomplish such motion comprises a power or lead screw linkage design. A lead screw (141) is driven by a "pitch motor" (142) that is housed in a motor enclosure (143) and secured to the rotary table (121).

The pitch motor's output shaft (144) is connected to the lead screw (141) and a pair of sleeve portions (145) of the lead screw (141) wrapped around each distal end of the lead screw is held in place by a pair of sleeve bearings or bushings. Said sleeve bearings each reside in or approximately within a bearing housing (146*a* and 146*b*) that each has an integrated mounting flange. Said mounting flanges of said bearing housings (146*a* and 146*b*) are fastened to the rotary table (121). If the output shaft (144) to lead screw (141) allows for degree-of-freedom along the thrust axis, a pair of retaining clips (159*a* and 159*b*) are placed at each end of the sleeve portions (145) to make sure the lead screw (141) is held stationary along this thrust axis as it is turned by the pitch motor (142).

The lead screw (141) is threaded through an ACME platform nut (148) such that as the lead screw (141) is turned by the pitch motor (142), the ACME nut (148) is linearly displaced relative along the lead screw (141). This ACME nut's (148) linear displacement actuates the linkage that governs the pitching axis of the launcher mounting plate (149), travel in a linear motion.

Fastened to the ACME nut (148) is a lead screw joint (150). A positioning arm (151) that helps translate the linear displacement of the ACME nut (148) into tilting kinematics of the launcher mounting plate (149), is connected on its lower end to the lead screw joint (150) by way of a clevis pin (152*a*) that runs through bores of both the positioning arm (151) and lead screw joint (150). A retaining clip (153*a*) is attached to the clevis pin (152*a*) to prevent the pin (152*a*) from backing out of the bores. The other or upper end of the positioning arm (151) is connected to a positioning arm joint (154) in the same manner that comprises another clevis pin (152*b*) disposed through the bores of both the positioning arm (151) and positioning arm joint (154), where said pin (152*b*) is held in place by another retaining clip (153*b*). The positioning arm joint (154) in turn is fastened to the end of the launcher mounting plate (149) furthest from the pitch motor (142).

Near the end of the launcher mounting plate (149) opposite the positioning arm joint (154) are a pair of launcher rotation joints (155*a* and 155*b*) that are fastened to the distal ends of the launcher mounting plate (149). The launcher rotation joints (155*a* and 155*b*) have pin bores that are along the launcher mounting plate's (149) axis of rotation. The launcher rotation joints (155*a* and 155*b*) are each attached to a fixed rotation joint (155*a* and 155*b*) by a pair of clevis pins (157*a* and 157*b*) each disposed through the bores of the launcher rotation joints (155*a* and 155*b*) and a pair of fixed rotation joints (156*a* and 156*b*), wherein said clevis pins (157*a* and 157*b*) are prevented from backing out of the bores by a pair of retaining clips (158*a* and 158*b*). Said fixed rotation joints (156*a* and 156*b*) each identically have a flanged structure with fastener holes on the feet so that the fixed rotation joints (156*a* and 156*b*) are fastened to the rotary table (121). The preferred material embodiment for the pitch motor output shaft (144), lead screw (141), sleeves (145), positioning arm (151), all joints (150, 154, 155*a*, 155*b*, 156*a*, 156*b*), and all pins (152*a*, 152*b*, 157*a*, and 157*b*) of the PM (140) is a high-strength corrosion-resistant metal such as stainless steel. The preferred material embodiment of the launcher mounting plate (149) is a high strength-to-mass metal that is corrosion resistant in the atmosphere like aluminum.

V) Ball Launcher Mechanism (160)—Ref. FIGS. 1A-B and 7A-D

The Ball Launcher Mechanism or BLM (160) allows for either a softball or baseball (161) to be launched at various distances and speeds. This is accomplished by a spring-loaded mechanism that, after a coil spring (162) is sufficiently compressed, can apply enough force to the ball (161) to initiate a launch. Said coil spring (162) is constrained on one end by a spring seat/guide (163) and a piston (164) on the other end. The preferred structural embodiment of the spring seat/guide (163) is one comprising an annular flange where one end of the coil spring (162) can engage. The body of the spring seat/guide (163) has a cylindrical or rod-like structure whose outer diameter is slightly smaller than the inner diameter of said coil spring (162) and the length of the spring seat (163) runs approximately as long as the fully compressed length of said coil spring (162). The cylindrical or rod-like shape of the spring seat/guide (163) helps stabilize the coil spring (162) from lateral deflections during spring compression and decompression.

Figure 7B:
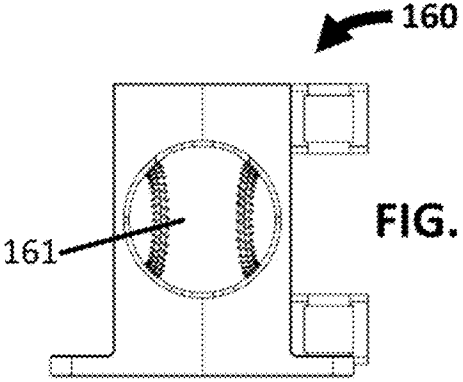
FIG. 7B shows the front discharge bore-side view of the Ball Launcher Mechanism
Figure 7D:
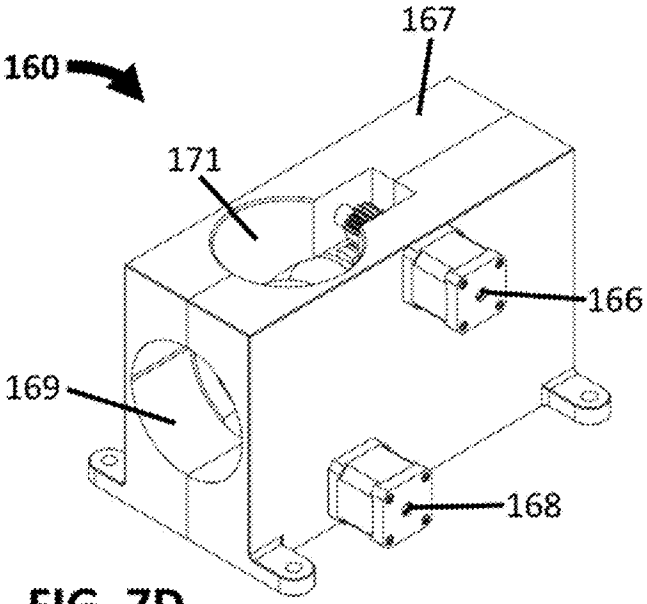
FIG. 7D shows an isometric top discharge bore-side view of the Ball Launcher Mechanism
Figure 7A:
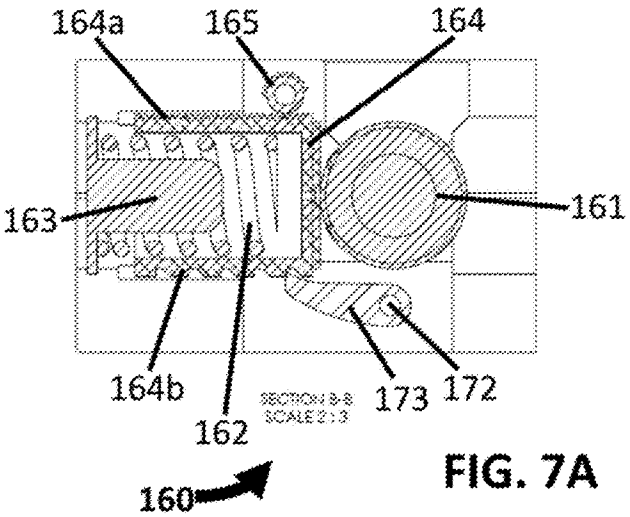
FIG. 7A shows the side B-B section view of the internal components of the Ball Launcher Mechanism in a ball-loaded state

The preferred embodiment of said piston (164) has gear teeth (164*a*) or top surface gear teeth on the upper piston skirt and a pawl gear (164*b*) on the bottom piston skirt. A gear ("sector gear") (165), has gear teeth on approximately half of the sector gear's circumference, to engage the top surface gear teeth (164*a*). The sector gear (165) is attached to a shaft of a motor ("sector motor") that is placed in an enclosure (166) that is in turn securely fastened to one side of a launcher housing (167) as shown in the preferred embodiment illustrated in FIG. 7D. The pawl gear (164*b*) in concert with a pawl (173), forms a rachet-like mechanism, wherein the pawl gear (164*b*) has sloped teeth that allow piston motion in the direction that compresses the coil spring (162) while preventing motion in the other direction when engaged to the pawl (173); this type of arrangement allows for locking the piston (164) at different compression lengths of the coil spring (162). A second motor ("pawl motor") in its own enclosure (168) is securely fastened to one side of the launcher housing (167) as shown in FIG. 7D. The pawl motor is only meant to rotate the pawl (173) to engage/ disengage said pawl gear (164*b*) to lock/unlock the piston (164), respectively, and allow the ball (161) to be discharged.

The sector gear (165) transfers torque from the sector motor to the top surface gear teeth (164*a*) to displace the piston (164) and compress the coil spring (162). This allows for the piston (164) to compress to various lengths and have variable force, depending on how far the ball (161) is to launch. After the spring (162) has been compressed to a certain length that corresponds to the user's desired ball trajectory distance, the pawl motor's output shaft (172) that is connected to the pawl (173) at its axis of rotation (172), will rotate counterclockwise, thereby releasing the coil spring (162), which in turn, exerts an ejection force on the ball (161) so that the ball (161) leaves the discharge barrel (169) of the BLM (160) at a certain velocity and momentum.

Figure 7C:
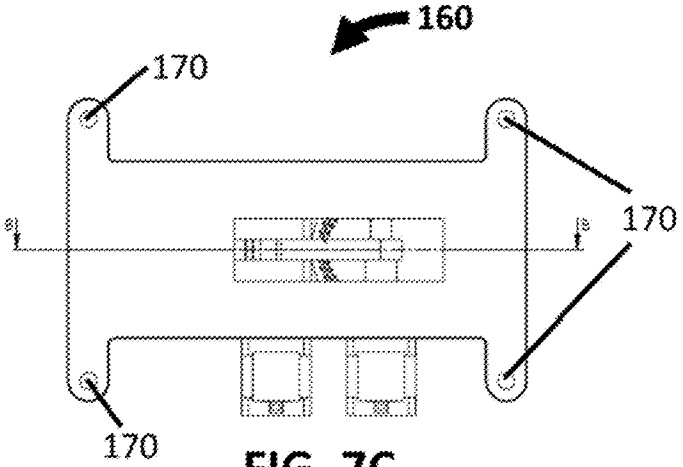
FIG. 7C shows the bottom view of the Ball Launcher Mechanism and indication of the B-B section line

The components described in this section are all housed within or on the launcher housing (167), which can be mounted to the launcher mounting plate (149) by fasteners disposed through the holes in the "feet" of the flanges (170) protruding from the corners of the launcher housing (167) as shown in FIG. 7C. Both the BLM (160) and launcher mounting plate (149) are mounted relatively low on the Chassis Assembly (110) as shown in FIGS. 1A-B, so that the reaction tipping moment of the chassis is minimized when the ball (161) is launched.

The preferred embodiment of the launcher housing (167) is that it is made from two halves joined together as shown in FIG. 7D. The launcher housing (167) also has a cutout or feed port (171) for an elastic hose or net to pass balls (161) through. The feed port (171) can be formed to have the sector gear (165) be exposed as well, to facilitate access during servicing and maintenance.

The preferred material embodiment for the gears in the BLM (164*a*, 164*b*, and 165), pawl (167), motor output shafts, and piston (164) is a high-strength corrosion-resistant metal such as stainless steel. The gear material is also wear-resistant and some lubricant can be applied between the mating surfaces of the gear teeth (164*a*, 164*b*, and 165) as well as the pawl (173). The preferred material embodiment of the coil spring (162) is spring steel, which has a long fatigue life.

VI) Ball Feeder Mechanism (180)—Ref. FIGS. 1A-B, 7D, 8A-D, 9, and 10

The Ball Feeder Mechanism or BFM (180), as shown in FIGS. 8A-D, 9, and 10, allow for the PFS (100) to hold a supply of softballs and/or baseballs (161) and load them into the BLM (160). This is accomplished by housing the balls (161) in a hopper (181) which is mounted to a ball loading retainer (182).

The disclosed embodiment of the hopper (181) is a semi-enclosed circular bin that has an open end at the top and an upper feeder plate (183) at the bottom with a preferably 90° pie-shaped cutout (184). This pie-shaped cutout (184) is sized to be a little larger than one ball (161) to allow only one ball (161) to pass through to the ball loading retainer (182) at a time. An embodiment of the upper feeder plate (183) may have a slightly graded plate topology that lowers slightly toward the pie-shaped cutout so that all balls (161) in the hopper (181) will eventually gravitate toward the pie-shaped cutout (184) during repeated ball launches.

Figure 8C:
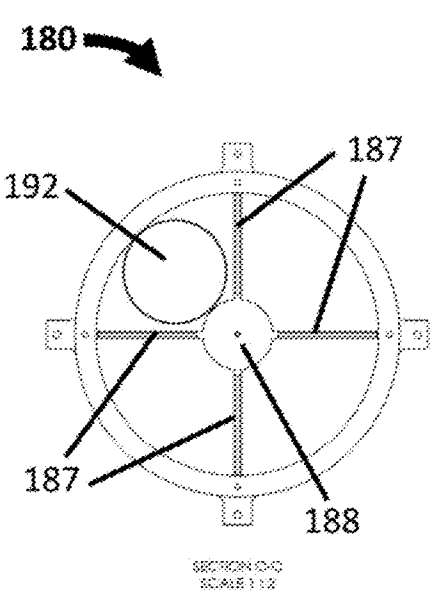
FIG. 8C shows the ball loading retainer below the C-C section line and the ball sweep brackets of the Ball Feeder Mechanism
Figure 8B:
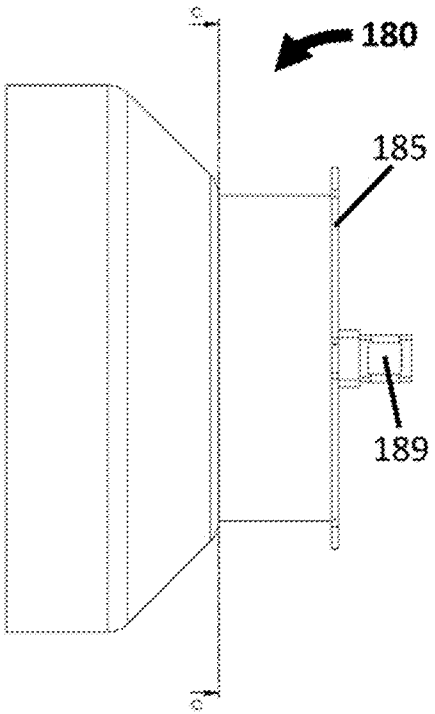
FIG. 8B shows the side of the hopper and ball loading retainer of the Ball Feeder Mechanism and indication of the C-C section line
Figure 8A:
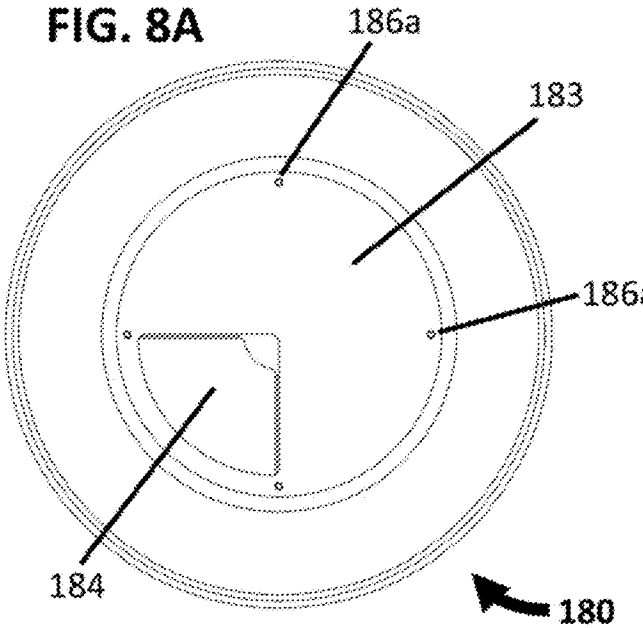
FIG. 8A shows the top of the hopper portion of the Ball Feeder Mechanism
Figure 8D:
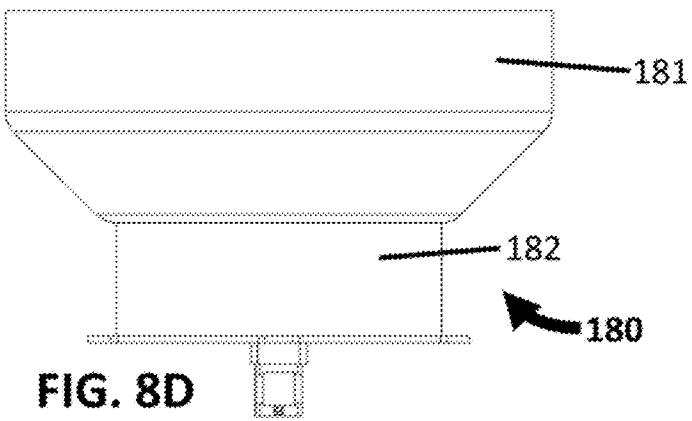
FIG. 8D shows the upright side view of the Ball Feeder Mechanism
Figure 9:
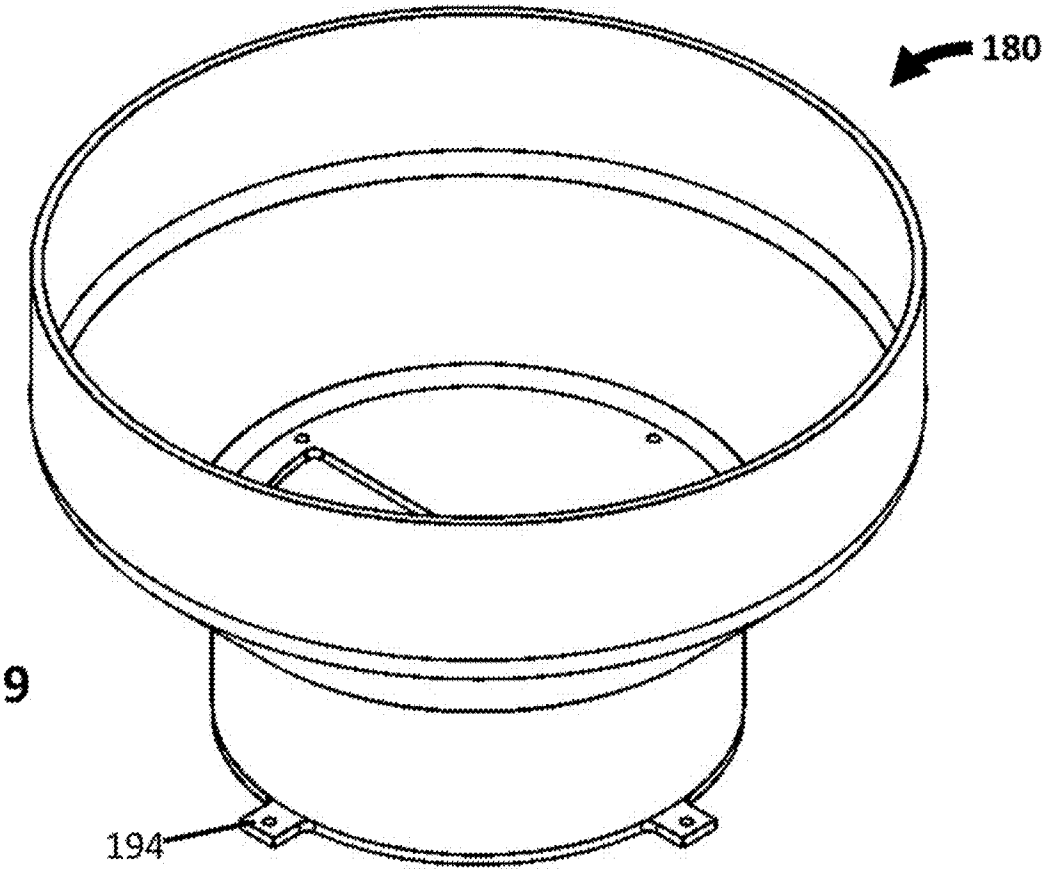
FIG. 9 shows an isometric view of the Ball Feeder Mechanism
Figure 10:
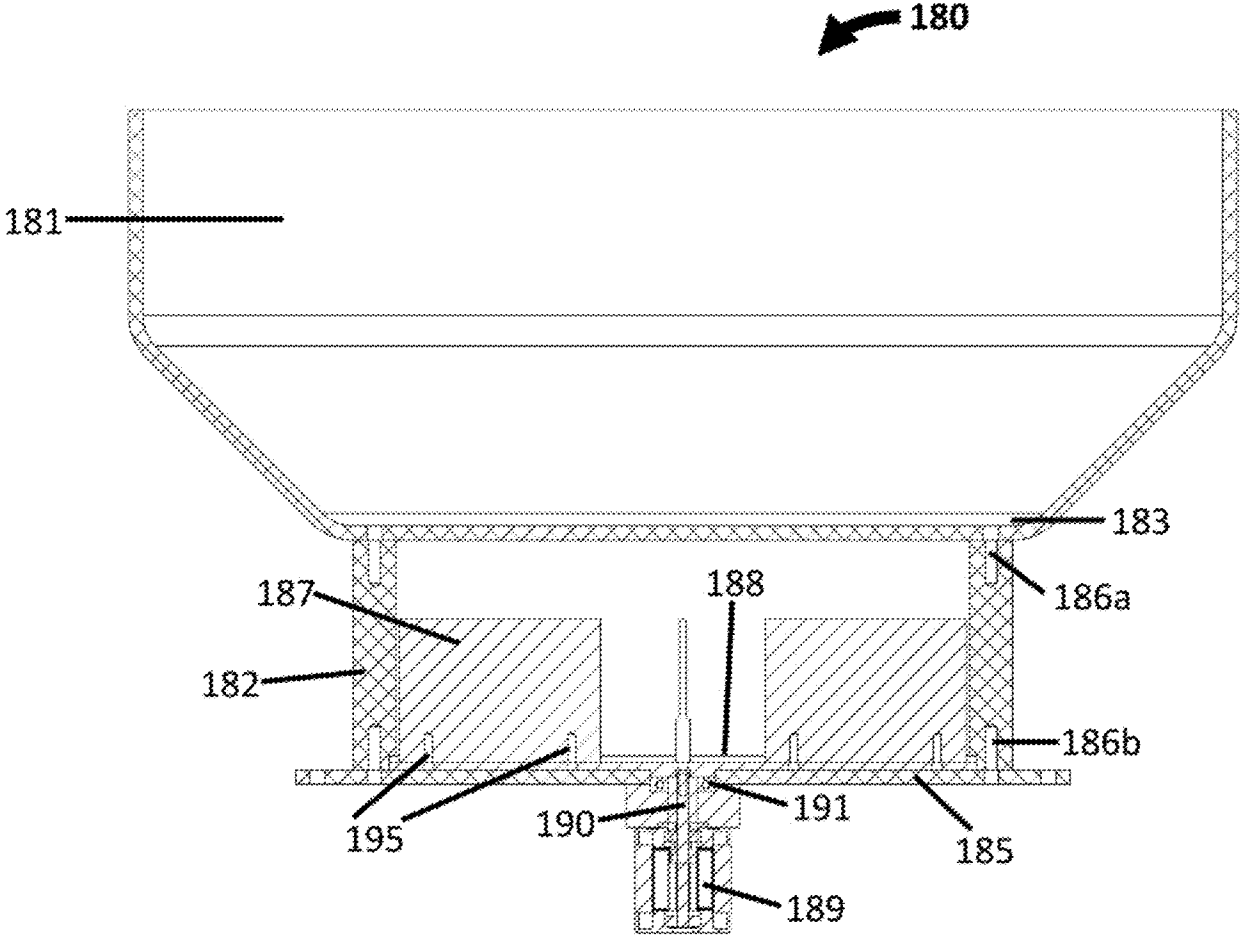
FIG. 10 shows a side C-C section view of the Ball Feeder Mechanism
Figure 11B:
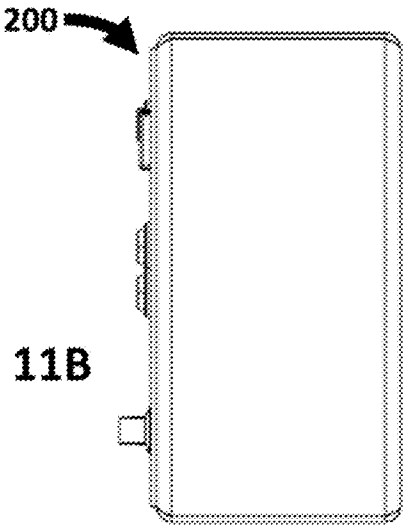
FIG. 11B shows the side view of the Control System Assembly
Figure 11D:
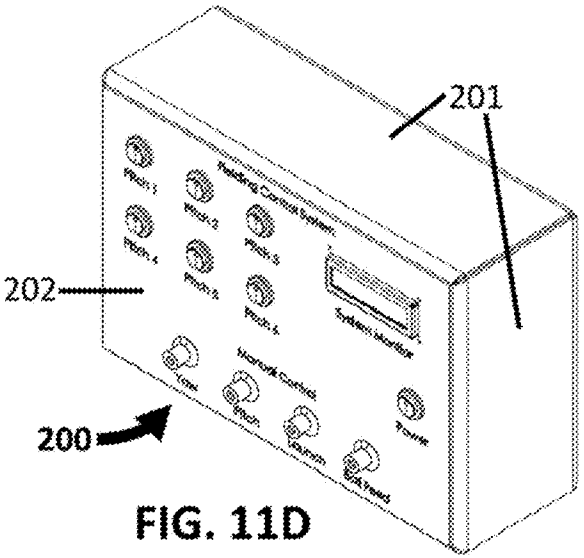
FIG. 11A shows the user interface and display faceplate of the Control System Assembly
FIG. 11C shows the bottom of the Control System Assembly FIG. 11D isometric top faceplate view of the Control System Assembly
Figure 11A:
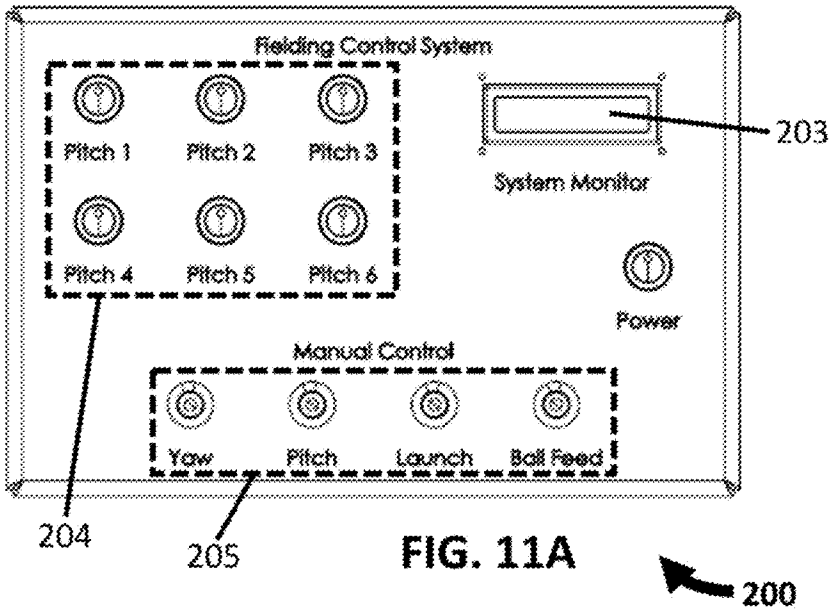
Figure 11C:
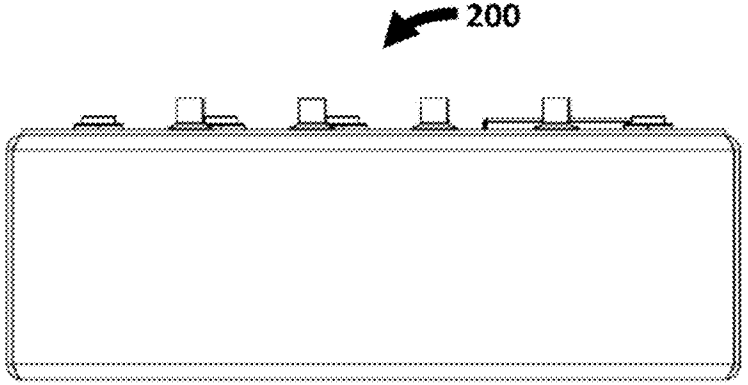

The upper feeder plate (183) in between the hopper (181) and the ball loading retainer (182). The hopper (181) is integrated with the upper feeder plate (183) and both are rotationally fixed with the ball loading retainer (182) by a plurality of pegs (186*a*) as indicated in FIGS. 8A and 10, wherein said hopper pegs (186*a*) are periodically arranged at 90° arc intervals around the bottom radial extent of the hopper (181) onto peg holes at the same 90° arc intervals along the top annulus of the ball loading retainer (182).

The ball loading retainer (182) is placed on a base plate (185). A plurality of pegs (186*b*) periodically arranged at 90° arc intervals along the circumference of the base plate (185) is placed through the peg boreholes in the ball loading retainer (182) to prevent the ball loading retainer (182) from spinning as a ball sweep gate or bracket (187) rotates along the inner walls of the ball loading retainer (182).

In the shown embodiment of the ball loading retainer (182), a total of up to four balls (161) can be loaded at the same time. A ball sweep bracket's hub (188) is connected to a motor or "ball feeder motor" (189) by way of a driveshaft (190) connected to or integrated with the motor's output shaft. Extending out of the ball sweep bracket's hub (188), are preferably four arms that each connect to a ball sweep bracket (187) by way of a pair of pins or pegs (195) as shown in FIG. 10. A ball bearing (191) allows for smooth, low friction rotation of the driveshaft (190) and ball sweep bracket (187). When the ball feeder motor (189) spins, the ball sweep bracket (187) turns the balls (161) in the loading retainer (182), where it remains within the loading retainer (182) until a ball (161) encounters a preferably circular opening (192) through the base plate (185) that is larger than one ball as shown in FIGS. 8B-C. When that happens, gravitational force will pull the ball (161) out of the loading retainer (182) and through the opening (192).

Once the ball (161) exits the ball loading retainer (182), gravity continues to pull the ball down an elastic hose or netting conduit (193) as shown in FIGS. 1A-B, connected between the BFM (180) and the BLM's feed port (171), as shown in FIG. 7D. This elastic hose (193) will always be in tension so as to allow ball(s) (161) to not get stuck at any point. An embodiment of the clastic hose (193) has an internal surface that is slippery to prevent balls from getting stuck in the elastic hose and has an inner diameter that is preferably at least 10% larger than the diameter of the ball (161) the PFS (100) is designed for. The inner diameter of the elastic hose (193) is preferably less than or equal to the diameter of the feed port (171). Embodiments of the present invention have the BFM (180) mounted to the Chassis Assembly (110) by way of a plurality of fasteners, each disposed through one of a plurality of tabbed flanges (194) extending radially out from the base plate (185) and into one of a plurality of threaded holes on said Chassis Assembly (110), wherein each tabbed flange is preferably arranged at 90° arc intervals along the circumference of the base plate (185). FIGS. 8B-D, 1A, 1B, 9, and 10 show a preferred embodiment of four tabbed flanges (194) extending out from the base plate (185) at 90° arc intervals along the base plate's (185) circumference.

VII) Control System Assembly (200)—Ref. FIGS. 1A-B, 4, 5A, 6, 7A, 7D, 11A-D The Control System Assembly or CSA (200) allows the user to control the PFS (100) locally. FIGS. 11A-D show an embodiment of the CSA (200) comprising an enclosure (201), faceplate (202) with labels or markings around the various buttons, knobs, switches, and digital (e.g., LCD) display (203). Embodiments of the PFS (100) can be readily used for pitching on top of fielding.

The CSA (200) also features a microcontroller circuit board (not shown) that interfaces with a plurality of push-buttons (204) and rotary switches (205) to control the motors (128, 142, 189, sector motor in 166, and pawl motor in 168) on the various system mechanisms (120, 140, 160, and 180)

to create and execute different pitch types, ball kinematics, and ball trajectories. A subset of the disclosed motors (128, 142, sector motor in 166, and pawl motor in 168) are preferably servomotors, which are rotary actuators that allow for precise control of angular position and incorporate a sensor (not shown) for position feedback. For a servomotor embodiment, the microcontroller uses the feedback sensor to precisely control the rotary position of the motor. Embodiments using other motor types and position sensors, or position sensing methods are possible as long as they enable users to possess good control of the ball's trajectory.

Wires are used to join dedicated circuit ports of the microcontroller and the servomotors or motors and any position sensor so that the appropriate signal, signal duration, and delivered power can be communicated between the servomotors, sensor, and microcontroller. The CSA (200) and the motors (128, 142, 189, sector motor in its enclosure 166, and pawl motor in enclosure (168) are powered by a system battery (not shown) and may be housed inside or outside the enclosure (201), preferably lower on the chassis, but not so that the kinematic operation of the various system mechanisms (120, 140, 160, and 180) are interfered with. Embodiments of the system battery are rechargeable or disposable and replaceable.

In the preferred embodiment of the CSA (200), users can select from multiple different pre-programmed pitch types or ball launch trajectories at the push of a button (204). An embodiment of the CSA (200) allows users to create custom pitch types or ball launches (205), tag them with alphanumeric names and/or numbers using a soft or hard keypad or a plurality of buttons and knobs, and store them in the CSA's flash memory that can later be recalled and executed. Pre-programmed ball shooting trajectories comprise short pop flies, short hops, line drives, and long-range. Embodiments of the CSA have pre-programmed or user-definable programs or routines, where the programs execute a series of known or random pitch or ball launch trajectories at a certain number of repetitions.

Embodiments of the present invention can allow users to set custom pitch types into one or more of the preset buttons (204). The CSA (200) features a digital screen (203) that displays the type of pitch that is currently selected, among other system-level information. The selections made with these controls (204 and 205) will be mapped to corresponding motor driver signals and coil spring (162) compression levels so that the intended speed and trajectory of the ball (161) are realized as best as possible. Alternative embodiments of the controls (204, 205) are not physical or hard controls but soft controls that are virtually rendered as graphical user interface widgets in the touchscreen display (203), where the preferred embodiment of the display is a capacitive touchscreen.

Embodiments of the present invention include a remote, wireless controller (not shown) of the various system mechanisms (120, 140, 160, and 180). Remote-control embodiments can emulate the control offerings of the local, chassis-mounted CSA (200) and be through a dedicated portable controller or a software application on a digital device (e.g., smartphone) with its own portable power supply. Such embodiments will additionally require a means to map and encode the remote-control inputs into a signal that can be transmitted wirelessly, a wireless transmitter on the remote control, a wireless receiver on the local CSA (200), and a means to decode the incoming signal and decode the signals that will drive the various system mechanisms (120, 140, 160, and 180) in the manner intended. Alternative control embodiments comprise fielder gesture control by way of a video camera or system of video cameras connected to image processing circuitry with embedded logic to infer the desired pitch types, ball kinematics, or ball trajectories to execute.

An embodiment of the CSA's enclosure (201) also houses the system battery, which will power all the system motors and electronics. Preferred material embodiments of said enclosure (204) are sheet metal or plastic. The enclosure (201) may comprise a plurality of vents (not shown) to prevent excessive heat build-up in the enclosure (201) due to power dissipation from the microcontroller and/or solar heating of the enclosure (201), At least one vent can be placed along or near the enclosure's (201) top surface and at least one other vent facet near the bottom of the enclosure's (201) bottom surface to maximize cooling efficiency by natural convection means.

An embodiment of the PFS (100) has a video camera (not shown) powered cither by a standalone or said system battery and mounted directly on the Chassis Assembly (110), on the CSA's enclosure (201), or inside the CSA's enclosure (201). If the video camera is placed in the CSA's enclosure (201), a hole on the CSA's enclosure (201) where the video camera lens looks outward provides optical access. The video camera has built-in memory storage, preferably removable flash memory storage such as an SD or MicroSD card, to store recorded footage that can later be retrieved. An embodiment of the display (203) allows playback and control of the said video camera-recorded content.

VIII) Ball Return System (300)—Ref. FIGS. 8A-D and 12

FIG. 12 shows the optional Ball Return System (300), BRS, that helps users throw back fielded balls from some distance into a net and tube assembly that guides balls back into the hopper portion (181) of the BFM (180) with the aid of gravitational force. One of the key aspects is the BRS (300) is not physically coupled with the PFS (100) so that any displacement of the BRS (300) from ball-net interactions or environmental factors like a gust of wind will not perturb the PFS (100).

The BRS (300) comprises a pair of longitudinal members (301) that each connects to a front wheel (302) and a rear (303) wheel. A clevis pin is placed through the hub of each wheel and a hole in the longitudinal member (301). The rear distal ends of the longitudinal members (301) are connected by a wheel plane lateral member (not shown). The preferred embodiment of the BRS (100) has a pair of small braces or triangular-shaped plates that each connect one distal end of the wheel plane lateral member to the rear distal end of the nearest longitudinal member. A pair of lower rear vertical members (304) each connect at one end to the rear distal end of each of the longitudinal members (301). For structural rigidity, a pair of diagonal braces (305) each connecting one of the lower rear vertical members (304) with the closest longitudinal member (301).

Near the top end of the lower rear vertical members (304) at approximately the height of the subframe (111*c*) of the Chassis Assembly (110) are a pair of front net attachment structures (306). The front net attachments (306) are angled such they extend forward. Also near where the front net attachment structures (306) extend out from the lower rear vertical members (304) is where a pair of rear net attachment structures (307) that extend rearward. A plurality of rear net attachment cross members (308-310) laterally connects the rear net attachment structures (307) at different points.

A portion of the lateral edges of the rear net (311) is connected to each of the rear net attachment structures (307). A pair of side nets (312) each connect to a front net attachment (306) and rear net attachment (307). The bottom end of each of the side nets (312) is connected to the lateral edges of the rear net (311). Each of the lateral edges of the front net (313) is connected to the front net attachment structures (306).

Connected to the bottom extent of all nets (311-313) is the entire annulus of an entrance (315) of a hopper loading tube (314). The entrance (315) of the hopper loading tube (314) has an angled cut. The bottom outlet end (316) of the hopper loading tube has a flat cut and is above the height of the hopper's (181) open-end by an order of several ball diameters. One pair of structural links (317) that extends forward perpendicularly from one of the rear net attachment cross members (309) is connected to the outlet end (316) of the hopper loading tube (314) for stabilization of the hopper loading tube (314).

Embodiments of the hopper loading tube (314) may have a mechanism to retard the ball's speed into the hopper because high exit velocity may cause a sufficiently elastic collision with other balls (161) and bounce off the hopper (181) instead of being collected in the hopper (181). An energy dissipating embodiment can be a ball rolling channel lined with strands of fiber.

An embodiment of the BRS (300) has one or more wheel brakes to fix its position. Alternatively, to anchor the BRS (300) to the ground, an embodiment of the BRS has a plurality of ground stakes (318) that each applies a vertical downward force onto the longitudinal members (301) after an initial external force is applied down each of the stakes (318) into the ground and top of each of said longitudinal members (301). An embodiment of the ground stake (318) is an "L" shaped profile, where one end comprises a pointed tip to more easily penetrate into the ground. An alternative embodiment of the ground stake (318) has a horseshoe-like profile where both ends comprise a pointed tip.

The preferred embodiment of the BRS (300) has the front attachment structures (306) to a moderately lower height than the rear net attachment structures (307) so that users do not need to lob the ball (161) up as much to get the returned ball (161) into the BRS (300). However, the front net (313) needs to be high enough to capture a ball (161) that has bounced off the rear net (311). The exact relative differences in the front (313) and rear net (311) heights depends on the tension and elasticity of the nets. To reduce the chances of the ball (161) bouncing from any of the nets (311-313) and out of the BRS (300), the preferred embodiment is for the nets (311-313) to have low tension and low elasticity, such as fabric type with examples comprising polyester rayon, dacron, acetate, or nylon. Each strand of the low tension net (311-313) should be relatively mass dense to effectively dissipate the ball's kinetic energy with minimal elastic rebound and more promptly cause the returned ball (161) to fall through the hopper loading tube (314).

To increase the chances of the fielder throwing the ball (161) into the BRS (300), the splay angle of the front (306) and rear (307) net attachment structures is wide, preferably at least 20°. The preferred width range of the BRS (300) is one and half times to ten times wider than the PFS (100). An appearance embodiment of the rear net (311) comprises a colored and/or reflective target to better stand out from the BRS's (300) surroundings.

Preferred material embodiments of the members and links (301, 304, 305, 308-310, and 317) comprise a high strength to weight ratio metal that is corrosion resistant in the atmosphere, such as aluminum. The net attachment structures (306 and 307) are preferably made from a high strength to weight ratio metal that is corrosion resistant in the atmosphere, such as aluminum, or wood. If the net attachment structures (306 and 307) are made from wood, the base end of each of the attachment structures (306 and 307) slips into a metallic pole mount integrated near the top portion of the lower rear vertical member (304).

Many alterations and modifications may be made by those having ordinary skill in the art without departing from the spirit and scope of the embodiment. Therefore, it must be understood that the illustrated embodiment has been set forth only for the purposes of example and that it should not be taken as limiting the embodiment as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

80/20 INC. is a registered trademark of 80/20 Inc.

What is claimed is:

1. A system for receiving and launching a ball at a pre-determined speed, said system comprising:

a housing with a plurality of sides and a ball feed port;

a coil spring between a spring seat-guide and a piston;

said piston having a circular portion adjoined to a cylindrical skirt;

said piston further comprising a series of gear teeth on a first portion of said skirt and a pawl gear on a second portion of said skirt;

a sector gear, which has teeth on a portion of its circumference that are engageable to the gear teeth on the first portion of said skirt;

a pawl motor; and a pawl;

wherein:

said pawl motor is configured to rotate the pawl to engage/disengage said pawl gear to lock/unlock the piston, respectively;

said sector gear teeth when meshing with the gear teeth on the first portion of said skirt is capable, when receiving an applied torque, of imparting a force to displace said piston to compress said coil spring;

said pawl gear when engaged with said pawl forms a rachet-like mechanism, wherein the pawl gear has sloped teeth that allow for piston motion in the direction that compresses the coil spring while preventing motion in a direction opposite to said direction that compresses the coil spring;

said pawl gear when engaged with said pawl further allows for locking the piston at any one of various compression lengths of said coil spring which, in turn, sets one of a multitude of levels of ejection force that can be imparted on said ball when the pawl is disengaged from the pawl gear;

said housing within said plurality of sides comprises said coil spring, said spring seat-guide, said piston, said gear teeth of the first portion of said skirt, said pawl gear, said sector gear, and a cylindrical ball discharge barrel between said piston and one of the plurality of sides of the housing;

said ball feed port is configured to receive a ball or a plurality of balls and guide each of said ball(s) to a portion of said discharge barrel of said housing next to said circular portion of said piston.

2. The system as recited in claim 1, wherein said spring seat-guide further comprises:

an annular flange where one end of said coil spring can engage; and a cylindrical structure whose outer diameter is smaller than the inner diameter of said coil spring.

3. The system as recited in claim 1, wherein said applied torque imparted on said sector gear is provided by an output shaft of a sector motor attached to said sector gear.

4. The system as recited in claim 3, wherein said sector motor is placed in an enclosure that is in turn securely fastened to one of the plurality of sides of said housing.

5. The system as recited in claim 1, wherein said pawl motor is placed in an enclosure that is in turn securely fastened to one of the plurality of sides of said housing.

6. System for launching a ball at a pre-determined speed, said system comprising:

a coil spring between a spring seat-guide and a piston;

said piston having a circular portion adjoined to a cylindrical skirt;

said piston further comprising a series of gear teeth on a first portion of said skirt and a pawl gear on a second portion of said skirt;

a sector gear, which has teeth on a portion of its circumference that are engageable to the gear teeth on the first portion of said skirt;

a pawl motor; and a pawl;

wherein:

said pawl motor is configured to rotate the pawl to engage/disengage said pawl gear to lock/unlock the piston, respectively;

said sector gear teeth when meshing with the gear teeth on the first portion of said skirt is capable, when receiving an applied torque, of imparting a force to displace said piston to compress said coil spring;

said pawl gear when engaged with said pawl forms a rachet-like mechanism, wherein the pawl gear has sloped teeth that allow for piston motion in the direction that compresses the coil spring while preventing motion in a direction opposite to said direction that compresses the coil spring;

said pawl gear when engaged with said pawl further allows for locking the piston at any one of various compression lengths of said coil spring which, in turn, sets one of a multitude of levels of ejection force that can be imparted on said ball when the pawl is disengaged from the pawl gear.

7. The system as recited in claim 6, wherein said spring seat-guide further comprises:

an annular flange where one end of said coil spring can engage; and a cylindrical structure whose outer diameter is smaller than the inner diameter of said coil spring.

8. The system as recited in claim 6, wherein said applied torque imparted on said sector gear is provided by an output shaft of a sector motor attached to said sector gear.

9. System for launching an object at a pre-determined speed, said system comprising:

a coil spring between a spring seat-guide and a piston;

said piston having a circular portion adjoined to a cylindrical skirt;

said piston further comprising a series of gear teeth on a first portion of said skirt and a pawl gear on a second portion of said skirt;

a sector gear, which has teeth on a portion of its circumference that are engageable to the gear teeth on the first portion of said skirt; and a pawl;

wherein:

said pawl is capable of rotating in a manner that engages to or disengages from said pawl gear to lock or unlock the piston, respectively;

said sector gear teeth when meshing with the gear teeth on the first portion of said skirt is capable, when receiving an applied torque, of imparting a force to displace said piston to compress said coil spring;

said pawl gear when engaged with said pawl forms a rachet-like mechanism, wherein the pawl gear has sloped teeth that allow for piston motion in the direction that compresses the coil spring while preventing motion in a direction opposite to said direction that compresses the coil spring;

said pawl gear when engaged with said pawl further allows for locking the piston at any one of various compression lengths of said coil spring which, in turn, sets one of a multitude of levels of ejection force that can be imparted on said object when the pawl is disengaged from the pawl gear.

10. The system as recited in claim 9, wherein said spring seat-guide further comprises:

an annular flange where one end of said coil spring can engage; and a cylindrical structure whose outer diameter is smaller than the inner diameter of said coil spring.

* * * * *